US006951153B2

(12) United States Patent
Berthlaume

(10) Patent No.: US 6,951,153 B2
(45) Date of Patent: Oct. 4, 2005

(54) NAIL GUIDING AND DRIVING TOOL

(76) Inventor: Raymond Berthlaume, 606 Chambertin, Rosemere (CA) J7A 4N8

( * ) Notice: Subject to any disclaimer, the term of this patent is extended or adjusted under 35 U.S.C. 154(b) by 0 days.

(21) Appl. No.: 11/009,000

(22) Filed: Dec. 13, 2004

(65) Prior Publication Data

US 2005/0126345 A1 Jun. 16, 2005

Related U.S. Application Data

(60) Provisional application No. 60/528,389, filed on Dec. 11, 2003.

(51) Int. Cl.[7] ..... B25C 3/00
(52) U.S. Cl. ..... 81/44; 81/437; 81/177.2
(58) Field of Search ..... 81/44, 437, 177.2, 81/54; 227/113, 147; D8/14, 51, 75, 83, 30, D8/307, 107

(56) References Cited

U.S. PATENT DOCUMENTS 1,158,430 A * 11/1915 Bell ..... 227/147
2,672,610 A * 3/1954 Colton ..... 227/147
2,839,754 A * 6/1958 Pfaff ..... 227/147
4,519,536 A * 5/1985 Steigauf ..... 227/147
5,529,234 A * 6/1996 Juneau ..... 227/147
5,921,456 A * 7/1999 Kirsch et al. ..... 227/147
D413,238 S 8/1999 Vasideva
6,076,431 A 6/2000 Vasideva
6,402,007 B1 * 6/2002 Dyer ..... 227/147

* cited by examiner

*Primary Examiner*—Joseph J. Hail, III
*Assistant Examiner*—Alvin J Grant

(57) ABSTRACT

A nail guiding and driving tool includes a substantially elongated tool body defining a hammer contacting surface and a longitudinally opposed nail contacting surface. The tool also includes a guiding sleeve slidably mounted relative to the tool body adjacent a distal end thereof. The sleeve channel defines a nail head receiving section extending inwardly from a sleeve distal end for receiving the nail head. The guiding sleeve is movable relative to the tool body between a sleeve extended configuration and a sleeve retracted configuration. When the guiding sleeve is in the sleeve extended configuration, the nail contacting surface is located within the sleeve channel and is recessed inwardly relative to the sleeve distal end so as to allow the nail head to be inserted into the nail head receiving section. A biasing component is provided for biasing the guiding sleeve towards the sleeve extended configuration.

12 Claims, 4 Drawing Sheets

NAIL GUIDING AND DRIVING TOOL

This application claims the benefit of Provisional Patent Application Sr. Nr. 60/528,389 filed Dec. 11, 2003.

FIELD OF THE INVENTION

The present invention relates to the field of tools and is particularly concerned with a nail guiding and driving tool.

BACKGROUND OF THE INVENTION

There exists a plurality of situations wherein it is desirable or necessary to drive a nail or the like into a relatively inaccessible location such as in a corner formed by two adjacent surfaces or in a relatively recessed area. In such situations, there exists a risk that the nail be inadvertently bent or misplaced. Also, the fingers of the worker may be injured and/or adjacent structures may be damaged.

Also, finishing carpentry work often requires that the nail be invisible and, hence, set beneath the surface of the wood by countersinking the nail and then covering the latter with plastic wood or putty. Countersinking nails often requires the use of a separate tool, one end of which is placed against the head of the driven nail while the other end is struck by a hammer to drive the nail into the wood without marring the surface.

Some prior art nail driving tools attempting to circumvent the hereinabove mentioned problems have been proposed. For example, U.S. Pat. No. 4,676,424 naming A. Leon Meader and Daniel B. Webber as inventors, issued Jun. 30, 1987 and U.S. Pat. No. 5,529,234 naming Michael A. Juneau as inventor, issued Jun. 25, 1996, both disclose structures including a cylindrical housing adapted to receive a nail and a piston strikable by a hammer for driving the nail out of the housing. Such structures, however, suffer from numerous drawbacks.

For example, the length of the section of the nail inserted within the housing increases the likelihood that the nail be jammed or warped in the housing during ejection therefrom by the piston. Also, the tool prohibits adequate visualization of the nail and of the work area adjacent the location into which the nail is being inserted. This, in turn, may potentially lead to improper positioning or alignment of the nail relative to the workpiece into which it is to be driven. Also, the rigid structure of the prior art structures is such that upon impact of the piston, there exists a risk that the housing may mark or otherwise damage the surface of the work piece into which the nail is being inserted.

Still, furthermore, the proposed prior art structures suffer from being overly complex and, hence, potentially costly and relatively unreliable. Accordingly, there exists a need for an improved nail guiding and driving tool.

SUMMARY OF THE INVENTION

It is a general object of the present invention to provide an improved nail guiding and driving tool.

In accordance with an embodiment of the present invention, there is provided a nail guiding and driving tool for allowing an intended user to drive a nail into a piece of material using a hammer, the nail including an elongated nail shank defining a nail tip and a longitudinally opposed nail head, the nail guiding and driving tool comprising: a substantially elongated tool body, the tool body defining a body longitudinal axis, a body first end and a longitudinally opposed body second end; the tool body defining a hammer contacting surface located adjacent the body first end and extending in a substantially perpendicular relationship relative to the body longitudinal axis; the tool body also defining a nail contacting surface located substantially adjacent the body second end and extending in a substantially parallel relationship relative to the hammer contacting surface; a guiding sleeve slidably mounted relative to the tool body adjacent the body second end, the guiding sleeve defining a sleeve channel extending longitudinally therethrough, the guiding sleeve also defining a sleeve distal end for contacting the piece of material, the sleeve channel defining a nail head receiving section extending inwardly from the sleeve distal end for receiving the nail head, the guiding sleeve being movable relative to the tool body between a sleeve extended configuration and a sleeve retracted configuration wherein, when the guiding sleeve is in the sleeve extended configuration, the nail contacting surface is located within the sleeve channel and is recessed inwardly relative to the sleeve distal end so as to allow the nail head to be inserted into the nail head receiving section; when the guiding sleeve is in the sleeve retracted configuration, the tool body protrudes outwardly from the sleeve channel with the nail contacting surface being positioned distally relative to the sleeve distal end so as to allow the nail contacting surface to drive the nail into the piece of material; a biasing component operatively coupled to the tool body and the guiding sleeve for biasing the guiding sleeve towards the sleeve extended configuration.

Conveniently, the nail head receiving section is configured and sized for substantially fittingly receiving the nail head. Conveniently, the nail head receiving section defines a receiving section inner surface, the receiving section inner surface having a nail centering portion, the nail centering portion having an inwardly tapering substantially frustroconical configuration. Typically, the nail head receiving section further includes a substantially cylindrical flange portion extending outwardly from the nail centering portion.

Typically, the tool body defines a sleeve accommodating section, the guiding sleeve being slidably mounted over the sleeve accommodating section for slidable movement over at least a portion thereof when the sleeve moves between the sleeve extended and retracted configurations.

Conveniently, the nail guiding and driving tool further comprises a housing wall peripherally surrounding at least a proximal portion of the sleeve accommodating section, the housing wall being spaced radially relative to the sleeve accommodating section so as to define a circumferential accommodating section-to-housing wall spacing therebetween.

Typically, the biasing component is configured and sized so as to be insertable in the accommodating section-to-housing wall spacing for abutment against the guiding sleeve so as to be resiliently compressed when the guiding sleeve moves towards the sleeve retracted configuration.

Conveniently, the housing wall is provided with a housing wall abutment flange extending radially inwardly therefrom substantially adjacent a distal end thereof; the guiding sleeve is provided with a guiding sleeve abutment flange extending radially outwardly therefrom substantially adjacent a proximal end thereof; the housing wall and guiding sleeve abutment flanges being positioned, configured and sized so as to abuttingly contact each other when the guiding sleeve is in the sleeve extended configuration.

Typically, the tool body defines a gripping section located adjacent the body first end for allowing gripping thereof by the intended user, the nail guiding and driving tool further including a deterrent for deterring the intended user from grasping the tool body at a location other then the gripping section. Typically, the deterrent includes a deterring protrusion protruding radially outwardly from the tool body intermediate the gripping section and the body second end.

Optionally, the guiding sleeve is provided with indicia marked thereon for providing an evaluation of the degree of penetration of the nail into the piece of material.

Advantages of the present invention include the proposed driving tool being useful for driving nails into relatively inaccessible places such as corners or recessed locations or for driving nails in situations wherein a hammer cannot be swung through its full arc. The proposed tool also allows for countersinking of nails so that the latter are set beneath the surface.

The proposed tool is adapted to reduce the risks of having the nail being jammed within the tool. Also, the proposed nail guiding and driving tool is adapted to facilitate alignment of the tool with the longitudinal axis of the nail so as to reduce the risk of damaging the nail and/or the piece of material into which it is being inserted.

Another advantage of the present invention resides in that the proposed nail guiding and driving tool is designed so as to facilitate visualization of both the nail and the work area adjacent the location into which it is to be driven.

The proposed tool facilitates evaluation of the depth of a nail during countersinking thereof.

The proposed tool is designed so as to be simple yet efficient. The proposed tool is also designed so as to be ergonomic and easy to use.

The proposed tool is designed so as to be manufacturable using conventional forms of manufacturing and conventional materials so as to provide a tool that will be economically feasible, long lasting and relatively trouble free in operation.

BRIEF DESCRIPTION OF THE DRAWINGS

An embodiment of the present invention will now be disclosed, by way of example, in reference to the following drawings in which.

DETAILED DESCRIPTION

Figure 1:
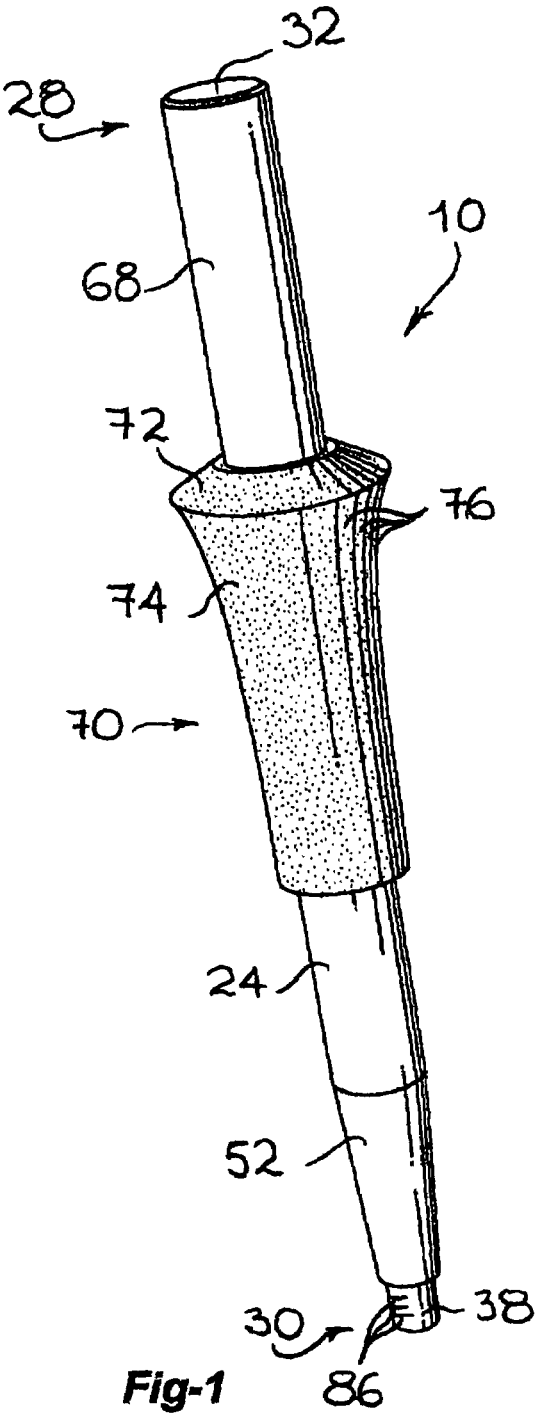
FIG. 1, in a perspective view, illustrates a nail guiding and driving tool in accordance with an embodiment of the present invention.

Referring to FIG. 1, there is shown a nail guiding and driving tool, in accordance with an embodiment of the present invention, generally indicated by the reference numeral 10. In FIGS. 5 through 8, the tool 10 is shown being used for driving a nail 12 into a piece wood 14.

The nail 12 includes an elongated nail shank 16 defining a nail tip 18 and a longitudinally opposed nail head 20. The piece of wood 14 is shown in the form of a plank defining a nail receiving surface 22.

It should, however, be understood that the tool 10 could be used for driving other types of components such as other parts of generally elongated fastening components into other types of materials and in different contexts without departing from the scope of the present invention. Also, it should be understood that the tool 10 could be used with nails 12 having other configurations such as other nail head configurations without departing from the scope of the present invention.

Figure 3:
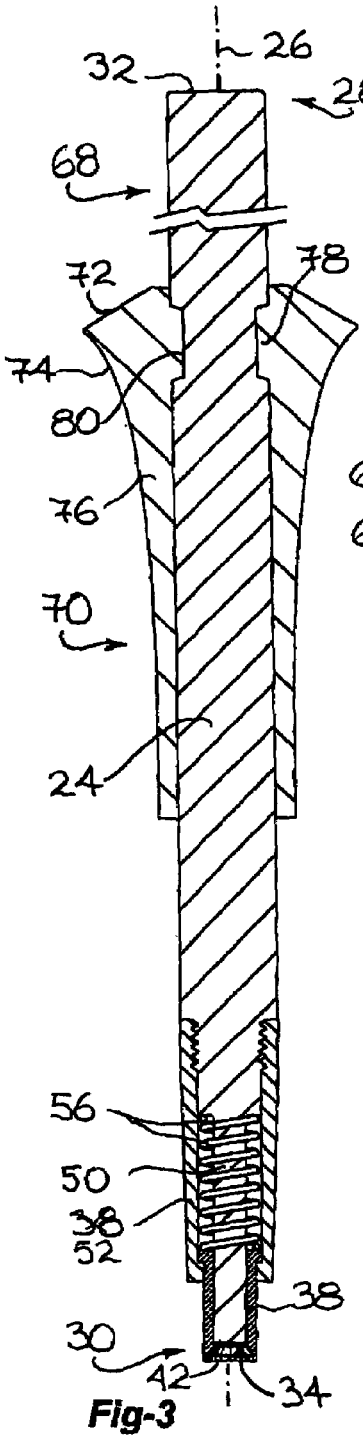
FIG. 3, in a longitudinal cross-sectional view with sections taken out, taken along arrows 3—3 of FIG. 2, illustrates some of the features of the nail guiding and driving tool shown in FIGS. 1 and 2.

As illustrated more specifically in FIG. 3, the tool 10 includes a substantially elongated tool body 24. The tool body 24 defines a body longitudinal axis 26.

The tool body 24 also defines a body first or proximal end 28 and a longitudinally opposed body second or distal end 30.

The tool body 24 defines a hammer contacting surface 32 located adjacent the body first end 28. The hammer contacting surface 32 typically extends in a substantially perpendicular relationship relative to the body longitudinal axis 26. It should be understood that although the hammer contacting surface 32 is typically intended to be impacted by a hammer, other types of impacting tools could be used without departing from the scope of the present invention. Also, although the hammer contacting surface 32 is shown in FIG. 1 as having a generally disc-shape configuration, it should be understood that the hammer contacting surface 32 could have other configurations without departing from the scope of the present invention.

The tool body 24 also defines a nail contacting surface 34 located substantially adjacent the body second end 30. Typically, the nail contacting surface 34 extends in a substantially parallel relationship relative to the hammer contacting surface 32. Again, it should be understood that although the nail contacting surface 34 is shown having a generally disc-shape configuration, the nail contacting surface 34 could have other configurations without departing from the scope of the present invention.

Figure 4A:
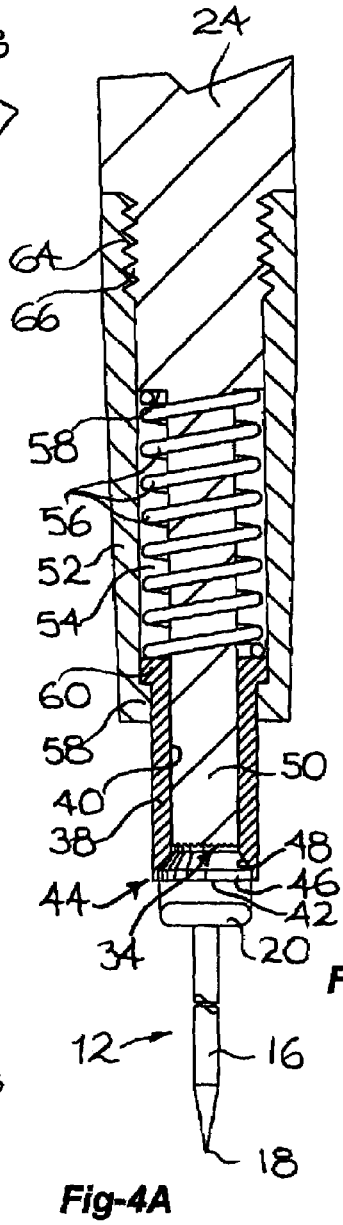
FIG. 4A, in a partial cross-sectional view with sections taken out, illustrates the distal portion of a nail guiding and driving tool in accordance with an embodiment of the present invention, the tool being shown with its guiding sleeve in a sleeve extended configuration.
Figure 4B:
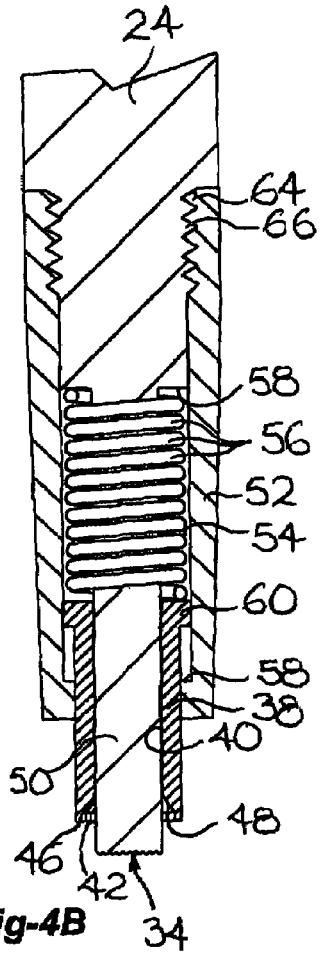
FIG. 4B, in a partial cross-sectional view with sections taken out, illustrates the distal portion of a nail guiding and driving tool in accordance with an embodiment of the present invention, the tool being shown with its guiding sleeve in a sleeve retracted configuration.

As shown more specifically in FIGS. 4A and 4B, the nail contacting surface 34 is typically provided with friction enhancing means such as serrations 36 formed thereon for enhancing the frictional contact with the nail head 20. It should, however, be understood that the nail contacting surface 34 could be deprived of such serrations and/or provided with other features without departing from the scope of the present invention.

The tool 10 also includes a guiding sleeve 38 slideably mounted relative to the tool body 24 adjacent the body second end 30. The guiding sleeve 38 defines a sleeve channel 40 extending longitudinally therethrough.

The guiding sleeve 38 also defines a sleeve distal end 42 for contacting the piece of material 14. The sleeve channel 40 defines a nail head receiving section 44 extending inwardly from the sleeve distal end 42 for receiving the nail head 20.

Figure 7:
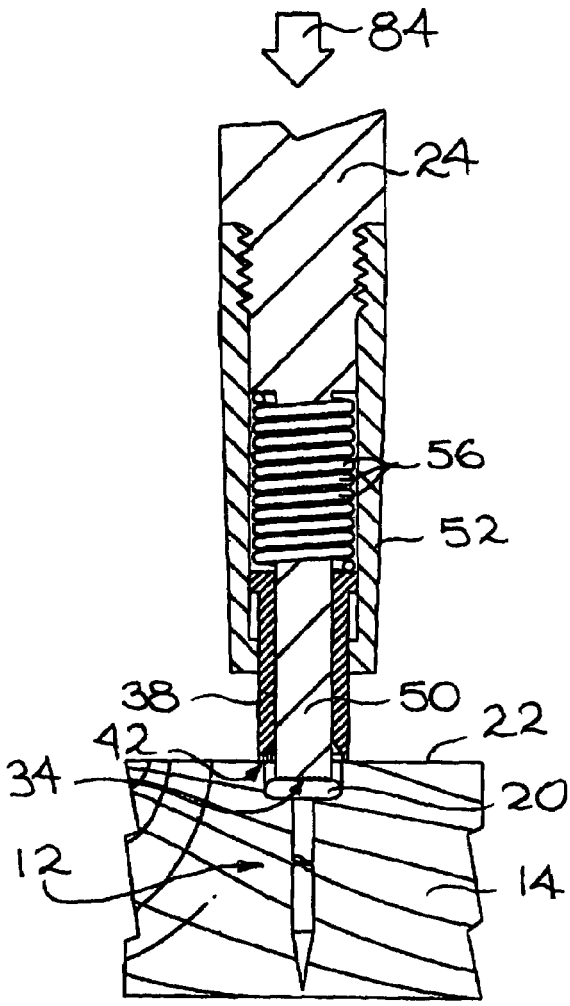
FIG. 7, in a partial cross-sectional view with sections taken out, illustrates the nail shown in FIGS. 5 and 6 being driven into the piece of wood by the nail guiding and driving tool shown in FIGS. 1 through 6, the nail guiding and driving tool being shown with its sleeve in a sleeve retracted configuration.

The guiding sleeve 38 is moveable relative to the tool body 24 between the sleeve extended configuration shown throughout the Figures, except for FIGS. 4B and 7, and a sleeve retracted configuration shown in FIGS. 4B and 7. As shown more specifically in FIG. 4A, when the guiding sleeve 38 is in the sleeve extended configuration, the nail contacting surface 34 is located within the sleeve channel 40 and is recessed inwardly relative to the sleeve distal end 42 so as to allow the nail head 20 to be inserted into the nail head receiving section 44.

As illustrated in FIGS. 4B and 7, when the guiding sleeve 38 is in the sleeve retracted configuration, the tool body 24 protrudes outwardly from the sleeve channel 40 with the nail contacting surface 34 positioned in register or distally relative to the sleeve distal end 42 so as to allow the nail contacting surface 34 to drive the nail 12 into the piece of material 14.

Figure 6:
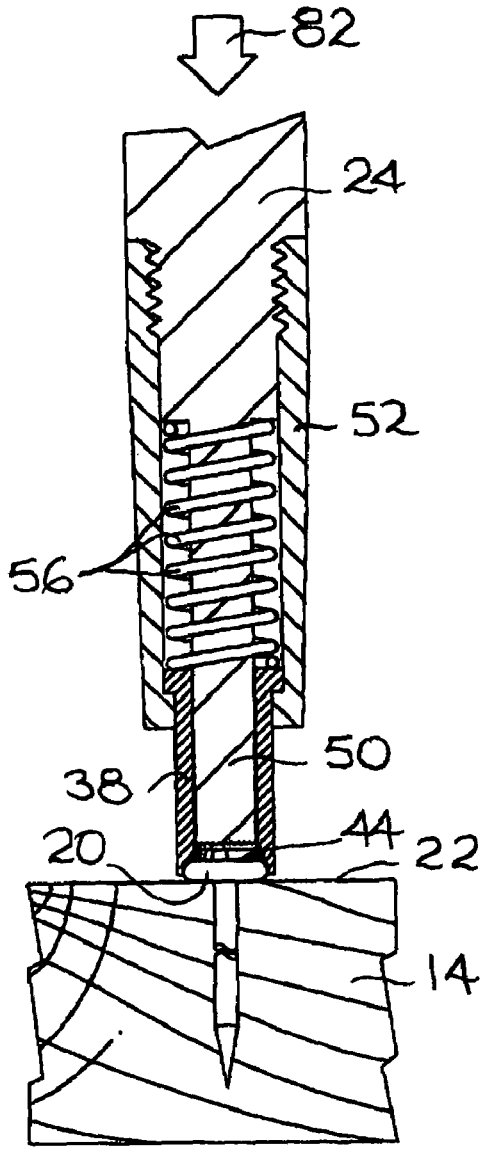
FIG. 6, in a partial cross-sectional view with sections taken out, illustrates the head of the nail shown in FIG. 5 nested within a corresponding nail head receiving section part of the nail guiding and driving tool in accordance with an embodiment of the present invention, the nail guiding and driving tool being shown with its sleeve in a sleeve extended configuration.
Figure 9:
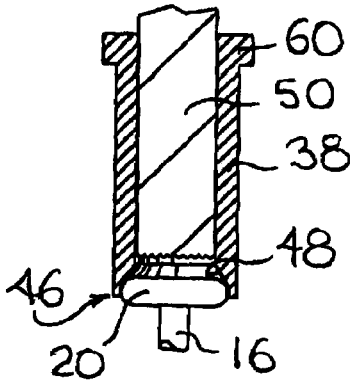
FIG. 9, in a partial cross-sectional view, illustrates the position of the nail head relative to the nail head receiving section of the sleeve when a relatively large nail head is being used.
Figure 10:
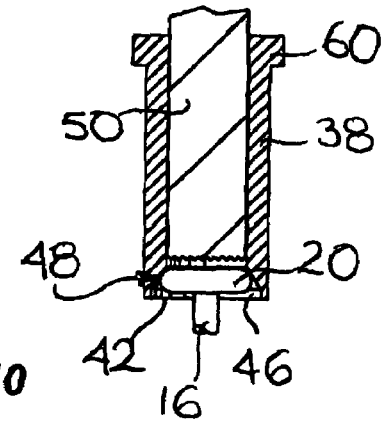
FIG. 10, in a partial cross-sectional view, illustrates the position of the nail head relative to the nail head receiving section of the sleeve when a smaller nail head is being used.

As shown more specifically in FIGS. 6, 9 and 10, the nail head receiving section 44 is typically configured and sized for substantially fittingly receiving the nail head 20. Hence, optionally, different guiding sleeves 38 having different nail head receiving section configurations could be used so as to more specifically match or be customized with corresponding nail head configurations.

The nail head receiving section 44 defines a receiving section inner surface. As shown more specifically in FIG. 4A, the receiving section inner surface includes a substantially cylindrical inner surface distal portion 46 extending inwardly from the sleeve distal end 42. Typically, the inner surface distal portion 46 is configured and sized so that its diameter substantially corresponds to that of the nail head 20.

Typically, the receiving section inner surface further defines a nail centering portion 48 extending inwardly from the inner surface distal portion 46. The nail centering portion 48 typically has an inwardly tapering substantially frustro-conical configuration. The frustro-conical configuration of the nail centering portion 48 is adapted to facilitate alignment of the body longitudinal axis 26 with the longitudinal axis of the nail so as to ensure optimal driving of the nail 12 into the piece of material 14.

As shown more specifically in FIG. 9, the substantially frustro-conical configuration of the nail centering portion 48 is also adapted to promote alignment of the body longitudinal axis 26 with the longitudinal axis of the nail 12 when the nail head 20 of the latter has a diameter smaller than the diameter of the inner surface distal portion 46. Indeed, the frustro-conical configuration ensures that the nail head 20 is substantially centered in the nail centering portion 48.

Figure 8:
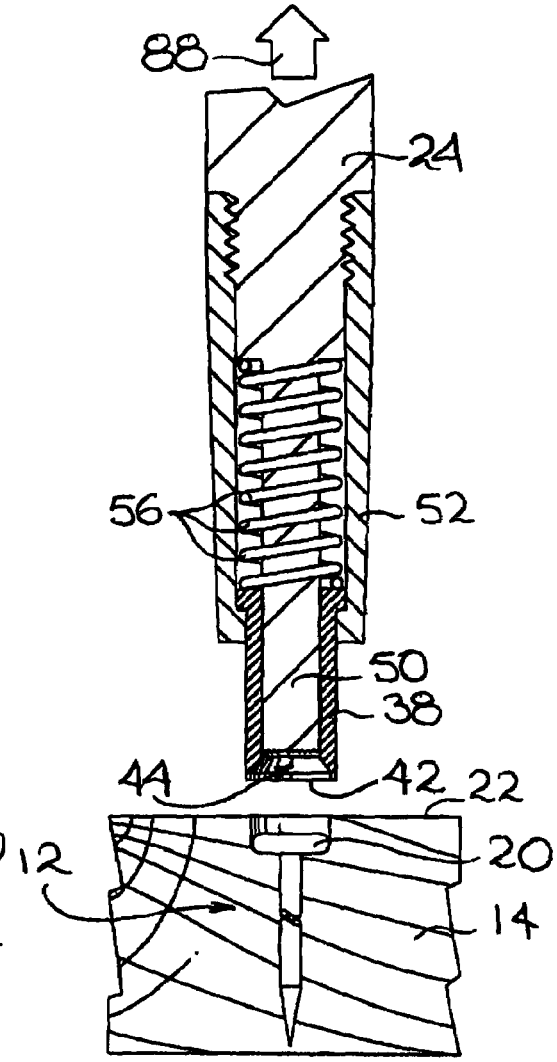
FIG. 8, in a partial cross-sectional view with sections taken out, illustrates the nail shown in FIGS. 5 through 7 inserted into the piece of wood with its nail head below the surface of the piece of wood and the nail guiding and driving tool being retracted from the piece of wood with its sleeve in an extended configuration.

Furthermore, since the nail centering portion 48 has a frustro-conical configuration, the external diameter of the nail contacting surface 34 is typically smaller than that of the inner surface distal portion 46 and, hence, then that of a corresponding nail head 20. This, in turn, ensures that the nail contacting surface 34 will be prevented from depressing the nail receiving surface 22 about the periphery of the nail head 20 when the latter is inserted below the nail receiving surface 22 such as shown in FIG. 8.

As shown more specifically in FIGS. 4A and 4B, the tool body 24 defines a sleeve accommodating section 50. The sleeve accommodating section 50 typically has a diameter smaller than that of the remainder of the tool body 24. The guiding sleeve 38 is slideably mounted over the sleeve accommodating section 50 for slideable movement over at least a portion thereof when the sleeve moves between the sleeve extended and retracted configurations.

The guiding sleeve 38 is optionally provided with indicia 86 marked thereon for providing an evaluation of the degree of penetration of the nail 12 into the piece of material 14 as will hereinafter be disclosed in greater details.

Typically, the nail guiding and driving tool 10 further includes a housing wall 52 peripherally surrounding at least a proximal portion of the sleeve accommodating section 50. The housing wall 52 is spaced radially outwardly relative to the sleeve accommodating section 50 so as to define a circumferential accommodating section-to-housing wall spacing 54 therebetween.

The nail guiding and driving tool 10 further includes a biasing component operatively coupled to the tool body 24 and the guiding sleeve 38 for biasing the guiding sleeve 38 towards the sleeve extended configuration. Typically, the biasing component is configured and sized so as to be insertable in the accommodating section-to-housing wall spacing 54 for abutment against the guiding sleeve 38 so as to be resiliently compressed when the guiding sleeve 38 moves towards the sleeve retracted configuration.

In the embodiment shown throughout the Figures, the biasing component includes a helicoïdal-type spring 56 mounted within the accommodating section-to-housing wall spacing 54. The spring 56 is shown having a first longitudinal end thereof abuttingly contacting a corresponding abutment shoulder 58 and a second longitudinal end thereof abuttingly contacting the guiding sleeve 38. It should, however, be understood that other types of biasing component could be used without departing from the scope of the present invention. For example, the biasing component could take the form of a cylindrical component made out of an elastomeric component or the like inserted within the accommodating section-to-housing wall spacing 54.

Typically, the housing wall 52 is provided with a housing wall abutment flange 60 extending radially inwardly therefrom substantially adjacent a distal end thereof. Also, typically, the guiding sleeve 38 is provided with a guiding sleeve abutment flange 62 extending radially outwardly therefrom substantially adjacent a proximal end thereof. The housing wall and guiding sleeve abutment flanges 60, 62 are typically positioned, configured and sized so as to abuttingly contact each other when the guiding sleeve 38 is in the sleeve extended configuration.

The contact between the housing wall and guiding sleeve abutment flanges 60, 62 is adapted to limit the distal excursion or movement of the guiding sleeve 38 as the latter protrudes outwardly from the accommodating section-to-housing wall spacing 54. The guiding sleeve abutment flange 60 is also adapted to provide an abutment surface for the helicoïcal-type spring 56.

In order to facilitate assembly of the nail guiding and driving tool 10, the housing wall 52 is typically made out of a separate piece of material attached to the remainder of the tool body 24 by a suitable attachment means. In the embodiment shown throughout the Figures, the housing wall 52 is releasably attached to the remainder of the tool body 24. This facilitates changing of the guiding sleeve 38 in situations wherein, for example, the guiding sleeve 38 is customized depending on the configuration of the nail head 20. Releasable attachment of the housing wall 52 also facilitates replacement of the biasing component when needed.

Throughout the Figures, the housing wall 52 is releasably attached to the remainder of the tool body 24 using an internal thread 64 formed on the inner surface of the housing wall 52 adjacent a proximal end thereof and a corresponding external thread 66 formed on the external surface of the tool body 24. It should, however, be understood that other types of attachment means could be used for attaching the housing wall 52 to the remainder of the tool body 24 without departing from the scope of the present invention. For example, the housing wall 52 could be glued to the remainder of the tool body 24. Also, the housing wall 52 could be made integrally with the remainder of the tool body 24 without departing from the scope of the present invention.

Figure 2:
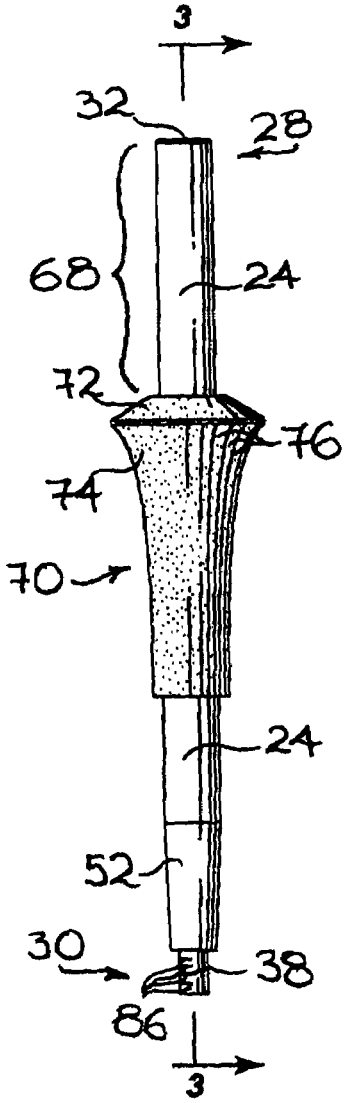
FIG. 2, in an elevational view, illustrates the nail guiding and driving tool shown in FIG. 1.

Referring back to FIGS. 1 and 2, there is shown that the tool body 24 defines a gripping section 68 located adjacent the body first end 28. The gripping section 68 may optionally be provided with a friction-enhancing means and/or cushioning means (both not shown) for increasing the comfort and ergonomic characteristics of the tool 10.

The nail guiding and driving tool 10 preferably further includes a deterrent for deterring the intended user from grasping the tool body 24 at a location other than the gripping section 68. Typically, the deterrent includes a deterrent protrusion 70 protruding radially outwardly from the tool body 24 intermediate the gripping section 68 and the body second end 30.

The deterrent protrusion 70 is typically configured so as to provide a non-ergonomical grip. In the embodiment shown throughout the Figures, the deterrent protrusion 70 defines a protrusion first section 72 tapering radially inwardly towards the gripping section 58 and a protrusion second section 74 extending from the protrusion first section 72. The protrusion second section 74 typically tapers radially inwardly in a direction leading away from the gripping section 68.

Also, typically, the deterrent protrusion 70 is made out of material so as to provide an unergonomical texture or grip. In the embodiment shown in FIGS. 1 through 3, the deterrent protrusion 70 includes deterrent strips 76 made out of a substantially deformable material. The deterrent strips 76 are adapted to deform independently from each other so as to provide an unpleasant or unsteady grip.

As shown more specifically in FIG. 3, the deterrent protrusion 70 is typically secured to the body 24 by a protrusion flange 78 inserted within a corresponding annular body recess 80. It should be understood that other types of deterrents such as other types of deterrent protrusions having other configurations, shapes, sizes, textures or the like could be used without departing from the scope of the present invention.

Optionally, some of the components of the nail guiding and driving tool 10 may be magnetized. Typically, the tool body 24, with the exception of the housing wall 52 is made out of an integral piece of suitable material such as an integral piece of steel or other suitable metallic alloy.

In use, the tool 10 is adapted to be grasped about the gripping section 68 by the fingers of an intended user. Grasping the tool 10 proximally, that is at a location substantially spaced from the nail contacting surface 34, is adapted to reduce the risks of forcing the nail 12 out of alignment.

Figure 5:
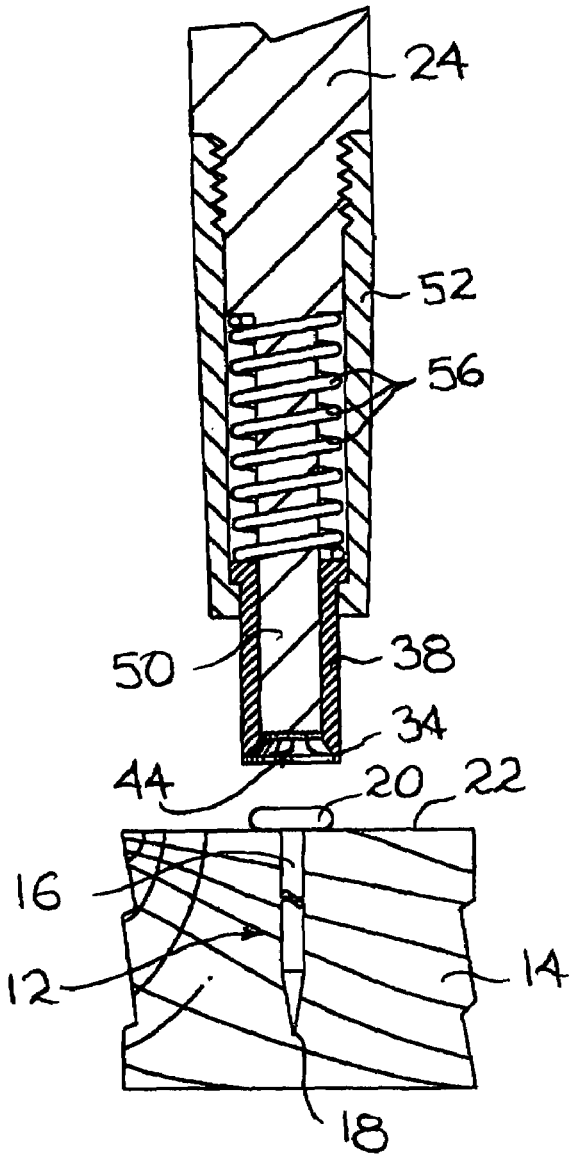
FIG. 5, in a partial cross-sectional view with sections taken out, illustrates the nail driving and guiding tool shown in FIGS. 1 through 4 about to contact a nail partially driven into a piece of wood.

As shown in FIG. 5, the nail 12 is typically initially partially driven through the nail receiving surface 22 into the piece of material 14 with the nail tip 18 inserted within the piece of material 14 and the nail head 20 protruding therefrom.

As shown in FIG. 6, the tool 10 is manually moved towards the nail 12 as indicated by arrow 82. The tool 10 is moved towards the nail 12 until the nail head 20 is nested within the nail head receiving section 44. Preferably, the tool 10 is positioned so that the body longitudinal axis 26 is substantially aligned with the longitudinal axis of the nail 12.

Alignment of the body longitudinal axis 26 with the longitudinal axis of the nail 12 is adapted to reduce the risks of damaging the nail 12 and/or the piece of material 14. As mentioned previously, the substantially frustro-conical configuration of the nail centering portion 48 is adapted to facilitate alignment of the body longitudinal axis 26 with the longitudinal axis of the nail 12. Indeed, should the body longitudinal axis 26 be angled relative to the longitudinal axis of the nail 12, upon a pressure being exerted by the tool 10 against the nail 12, the contact of the nail head 20 against the angled surface of the nail centering portion 48 will tend to promote proper alignment.

Furthermore, the inner surface distal portion 42 is typically configured and sized so as to substantially fittingly receive the nail head 20. This not only facilitates alignment of the body longitudinal axis 26 with the longitudinal axis of the nail 12, but also substantially reduces the risk of having a portion of the nail 12 jammed within the guiding sleeve 38.

Typically, proper alignment is further facilitated by having the sleeve distal end 42 abuttingly contact the nail receiving surface 22.

Once the nail head 20 is properly nested within the nail receiving section 44, a suitable impacting tool such as a conventional hammer (not sown) is used for striking or impacting the hammer contacting surface 32. The impact force causes the tool body 24 to move further towards the piece of material 14 as indicated by arrow 84 in FIG. 7. This forward movement of the tool body 24, in turn, causes the nail contacting surface 34 to push against the nail head 20 so as to drive the latter into the piece of material 14.

With the sleeve distal end 42 abutting against the nail receiving surface 22, this causes the guiding sleeve 38 to move towards its sleeve retracted configuration. Typically, the nail 12 is driven into the piece of material 14 until the nail head 20 is located below the nail receiving surface 22. The depth of the nail head 20 within the piece of material 14 may be evaluated using the indicia 86 provided on the external surface of the guiding sleeve 38. Indeed, the degree of retraction of the guiding sleeve 38 within the accommodating section-to-housing wall spacing 54 typically correlates with the degree of insertion of the nail 20 within the piece of material 14.

As the guiding sleeve 38 moves towards its retracted configuration, the helicoidal-type spring 56 is compressed by the latter. Once the nail 12 is satisfactorily inserted within the piece of material 14, the tool 10 is pulled away from the piece of material 14 as indicated by arrow 88 in FIG. 8. With the release of the contact between the guiding sleeve 38 and the piece of material 14, the helicoidal-type spring 56 resiliently biases the guiding sleeve 38 back towards its initial extended configuration.

I claim:

1. A nail guiding and driving tool for allowing an intended user to drive a nail into a piece of material using a hammer, said nail including an elongated nail shank defining a nail tip and a longitudinally opposed nail head, said nail guiding and driving tool comprising:

a substantially elongated tool body, said tool body defining a body longitudinal axis, a body first end and a longitudinally opposed body second end; said tool body defining a hammer contacting surface located adjacent said body first end and extending in a substantially perpendicular relationship relative to said body longitudinal axis; said tool body also defining a nail contacting surface located substantially adjacent said body second end and extending in a substantially parallel relationship relative to said hammer contacting surface;

a guiding sleeve slidably mounted relative to said tool body adjacent said body second end, said guiding sleeve defining a sleeve channel extending longitudinally therethrough, said guiding sleeve also defining a sleeve distal end for contacting said piece of material, said sleeve channel defining a nail head receiving section extending inwardly from said sleeve distal end for receiving said nail head, said guiding sleeve being movable relative to said tool body between a sleeve extended configuration and a sleeve retracted configuration wherein, when said guiding sleeve is in said sleeve extended configuration, said nail contacting surface is located within said sleeve channel and is recessed inwardly relative to said sleeve distal end so as to allow said nail head to be inserted into said nail head receiving section;

when said guiding sleeve is in said sleeve retracted configuration, said tool body protrudes outwardly from said sleeve channel with said nail contacting surface being positioned distally relative to said sleeve distal end so as to allow said nail contacting surface to drive said nail into said piece of material;

a biasing component operatively coupled to said tool body and said guiding sleeve for biasing said guiding sleeve towards said sleeve extended configuration.

2. A nail guiding and driving tool as recited in claim 1 wherein said nail head receiving section is configured and sized for substantially fittingly receiving said nail head.

3. A nail guiding and driving tool as recited in claim 1 wherein said nail head receiving section defines a receiving section inner surface, said receiving section inner surface having a nail centering portion, said nail centering portion having an inwardly tapering substantially frustro-conical configuration.

4. A nail guiding and driving tool as recited in claim 3 wherein said nail head receiving section further includes a substantially cylindrical flange portion extending outwardly from said nail centering portion.

5. A nail guiding and driving tool as recited in claim 1 wherein said tool body defines a sleeve accommodating section, said guiding sleeve being slidably mounted over said sleeve accommodating section for slidable movement over at least a portion thereof when said sleeve moves between said sleeve extended and retracted configurations.

6. A nail guiding and driving tool as recited in claim 5 further comprising a housing wall peripherally surrounding at least a proximal portion of said sleeve accommodating section, said housing wall being spaced radially relative to said sleeve accommodating section so as to define a circumferential accommodating section-to-housing wall spacing therebetween.

7. A nail guiding and driving tool as recited in claim 6 wherein said biasing component is configured and sized so as to be insertable in said accommodating section-to-housing wall spacing for abutment against said guiding sleeve so as to be resiliently compressed when said guiding sleeve moves towards said sleeve retracted configuration.

8. A nail guiding and driving tool as recited in claim 6 wherein said housing wall is provided with a housing wall abutment flange extending radially inwardly therefrom substantially adjacent a distal end thereof;

said guiding sleeve is provided with a guiding sleeve abutment flange extending radially outwardly therefrom substantially adjacent a proximal end thereof;

said housing wall and guiding sleeve abutment flanges being positioned, configured and sized so as to abuttingly contact each other when said guiding sleeve is in said sleeve extended configuration.

9. A nail guiding and driving tool as recited in claim 6 wherein said tool housing wall is releasably attached to the remainder of said tool body.

10. A nail guiding and driving tool as recited in claim 1 wherein said tool body defines a gripping section located adjacent said body first end for allowing gripping thereof by said intended user, said nail guiding and driving tool further including a deterrent for deterring said intended user from grasping said tool body at a location other then said gripping section.

11. A nail guiding and driving tool as recited in claim 10 wherein said deterrent includes a deterring protrusion protruding radially outwardly from said tool body intermediate said gripping section and said body second end.

12. A nail guiding and driving tool as recited in claim 1 wherein said guiding sleeve is provided with indicia marked thereon for providing an evaluation of the degree of penetration of said nail into said piece of material.

* * * * *